US005131050A

United States Patent [19]

Näslund

[11] Patent Number: 5,131,050

[45] Date of Patent: Jul. 14, 1992

[54] METHOD AND DEVICE FOR GENERATING SOUND IN A HALL

[76] Inventor: Jan Näslund, Terrassvägen 43, S-891 00 Örnsköldsvik, Sweden

[21] Appl. No.: 474,022

[22] PCT Filed: Oct. 20, 1988

[86] PCT No.: PCT/SE88/00551

§ 371 Date: Jun. 11, 1990

§ 102(e) Date: Jun. 11, 1990

[87] PCT Pub. No.: WO89/03919

PCT Pub. Date: May 5, 1989

[30] Foreign Application Priority Data

Oct. 26, 1987 [SE] Sweden ..... 8704162

[51] Int. Cl.[5] ..... H04R 27/00

[52] U.S. Cl. ..... 381/82

[58] Field of Search ..... 381/77, 80, 82; 181/30

[56] References Cited

U.S. PATENT DOCUMENTS 3,125,181 3/1964 Pawlowski ..... 381/82

4,672,675 6/1987 Powell et al. ..... 381/182

FOREIGN PATENT DOCUMENTS 0556566 6/1977 U.S.S.R. ..... 381/82

*Primary Examiner*—Forester W. Isen

*Attorney, Agent, or Firm*—Skjerven, Morrill, MacPherson, Franklin & Friel

[57] ABSTRACT

This invention relates to a device for generating sound in a hall comprising a first space for dancers and/or listeners and an adjacent second space, for instance a catering space. According to the invention a sound-ceiling (4) is arranged in the first space (2) in a distance from the floor, and is a large number of loudspeakers (5) arranged in the sound-ceiling.

8 Claims, 1 Drawing Sheet

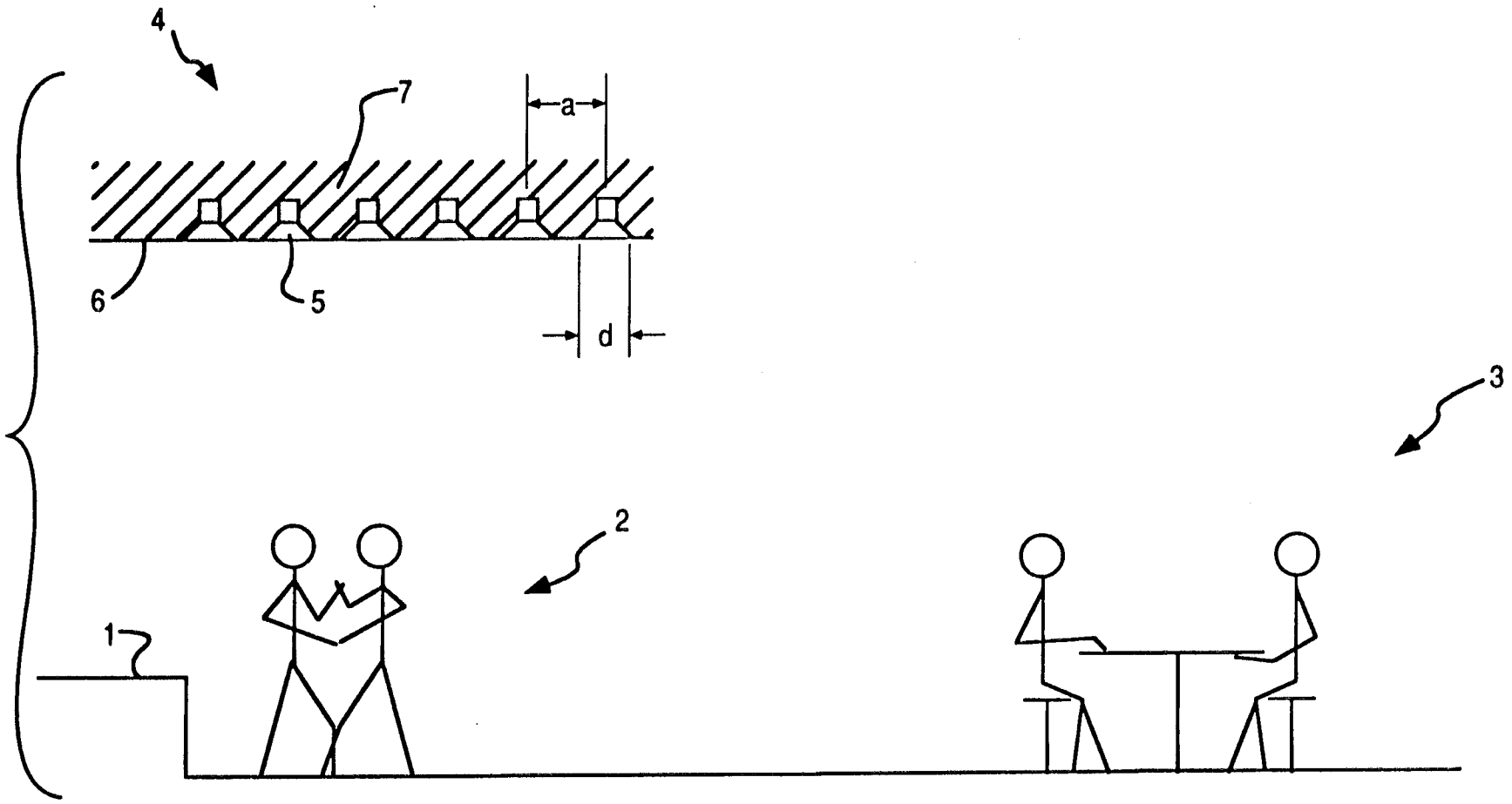
3
2
4
7
5
6
a
d
1

METHOD AND DEVICE FOR GENERATING SOUND IN A HALL

This invention relates to a device for generating sound in a hall comprising a first space for dancers and/or listeners and an adjacent second space, for instance a catering space. According to the standpoint of technique regarding dance-halls with a band positioned on a band stand the loudspeakers for the music sound as a rule are positioned on the band stand in such a way that the sound from these ones are directed out into the hall, where the dancers and the dinner guests are. In this connection the hall as a rule is designed in that way that the dance-floor is closest to the band stand and the space for those sitting at the tables and having their meals further away from the band stand.

the great disadvantage with loudspeakers on the band stand sending out the strong sound into the hall is that this sound also reaches the place where the dinner guests are sitting. Due to that fact a common conversational tone at the dining tables is made difficult, which is felt annoying by many of those sitting at the tables. Another disadvantage with common dance restaurants is that the strong music sound also rises upwards, and therefore hotel rooms positioned straight about the dance restaurant as a rule have not been able to be rent out.

The German patent 812.258 shows a device where the spoken sound from a speaker at a microphone reaches a certain area D. In order that the spoken sound shall reach further out into the hall a loudspeaker ramp L having several loudspeakers is directed obliquely downwards and outwards into the hall. Due to the fact the sound also reaches the area S. Thus, the intention with this idea is not to limit the sound within a certain area but to lead the sound out into the hall so that it reaches a larger area. Moreover, the patent does not show any sound-ceiling but only a ramp with loudspeakers.

The problems with known technique have been solved by the present invention. The solution comprises a device of the kind mentioned by way of introduction which is characterized in that a sound-ceiling is arranged in the first space in a distance from the floor and that a large number of loud-speakers are arranged in the sound-ceiling.

By this invention the music sound is essentially limited to that area where the dancers are. This has the great advantage that those sitting at the tables beyond the dance floor are not subjected to the strong sound by can converse in a common conversational tone. Due to the special design of the invention, the propagation of the sound upwards is also limited, and therefore also hotels rooms closest to the dance hall vertically can be rent out.

The invention shall be described more closely below, reference being made to the accompanying drawing which schematically shows dancers in one space and dinner guests at a table in an adjacent space.

In this drawing there is shown a band stand 1 and below and in front of this one a space 2 for the dancers. Beyond this space there is a catering space 3 for dinner guests and other sitting at tables for conversation. As a rule it is completely open between the spaces 2 and 3.

The novel and special thing with this invention is that the sound is distributed out via a sound-ceiling 4, which is placed above the heads of the dancers. This sound-ceiling comprises a large number of loudspeakers 5 having a special placing. The sound-ceiling comprises an essentially horizontal plate 6 provided with the loudspeakers, which are retracted in the plate, and further comprises a sound isolating layer 7 placed above the plate, whereby the propagation upwards of the sound is strongly reduced.

According to the invention the special sound-ceiling shall only be arranged in the space for the dancers, the number of loudspeakers and the placing of these ones being arranged in that way that the propagation of the sound is laterally minimized. If many loudspeakers are arranged in the sound-ceiling and the distance between the loudspeakers is limited, there arises something called destructive interference between the sound-waves from the loudspeakers. This means that the lateral sound-waves from one speaker is stopped by the lateral sound-waves from one speaker is stopped by the lateral sound-waves from an adjacent loudspeaker. In this way the sound-level outside the effective area of the sound-ceiling becomes exceedingly small, which positively influences the pitch of conversation in the adjacent catering space. According to the invention the loudspeakers are preferably round and placed in an essentially horizontal sound-ceiling and are directed downwards, the distance between the centres of two adjacent loudspeakers, each having the membrane diameter d, being less than or equal with 3.5 d. If two round loudspeakers having different membrane diameters are placed beside each other, the distance between the centres of these two loudspeakers shall be less than or equal with 3.5 of the larger one of the membrane diameters. The number of loudspeakers out to be at least $10/m^2$ of the effective area of the sound-ceiling and the effective area of the sound-ceiling out to be at least 5 $m^2$. With the effective area of the sound-ceiling is meant the area of that part of the sound-ceiling where the main part of the loudspeakers are placed. This means that when the effective area is 5 $m^2$ the number of loudspeakers in the sound-ceiling out to be at least 50.

Of course the loudspeakers can have another form than round. In such a case the distance between the centres of two similar, adjacent loudspeakers shall be less than or equal with 5/4 of the perimeter of the membrane of the loudspeaker.

If two adjacent loudspeakers have different size regarding the membranes, which are not round, the distance between the centres of these two loudspeakers shall be less than or equal with 5/4 of the perimeter of the larger membrane of the loudspeaker.

When using the sound-ceiling, it shall have a placing varying between the level immediately above to the level 3 meters above the heads of those present.

Since the effect of the destructive interference between the sound-waves from the loudspeakers diminishes the higher these ones are placed over the heads of those present, the sound-ceiling during use ought not to be placed more than 1 m over the heads of those present. It is also possible to have the sound-ceiling on a certain height over the floor in an inactive position and another, lower height over the floor during use, the ceiling in a suitable way being lowered and raised, respectively, between the different levels.

The field of the invention that has been mentioned is dance-restaurants. It is, of course, possible to use the invention in other fields, for instance in halls having one space where listeners listen to a speaker on a platform, while simultaneous discussions are going on between other people in an adjacent space.

Besides the advantages already mentioned with this invention it can also be mentioned that the need of effect becomes lower with this idea at the same time as the sound-level becomes more uniform over the effective area.

With the phrase "loudspeaker" in the description, claims and abstract is meant membrane of loudspeaker when it is a question about number.

I claim:

1. Method of generating sound in a space for people, characterized in that a sound-ceiling (4) is mounted in a space (2) and is given such a placing that it is positioned above the heads of the people being in the space, and that the sound-ceiling (4) is given a size of at least 5 $m^2$ and a number of loudspeakers of at least 50, resulting in that there arises a destructive interference between the sound-waves from the loudspeakers of the sound-ceiling (4), whereby the propagation of the sound from the sound-ceiling (4) to the area outside the space (2) is minimized.

2. A device for generating sound in a space for people, characterized in that it comprises a sound-ceiling (4) in a space (2) having such a placing that during use it is positioned above the heads of the people being in the space, that the effective area of the sound-ceiling is at least 5 $m^2$, and that the number of loudspeakers in the sound-ceiling (4) is at least 50, whereby there arises a destructive interference between the sound-waves from the loudspeakers of the sound-ceiling (4), so that the propagation of the sound from the sound-ceiling (4) to the area outside the space (2) is minimized.

3. A device according to claim 2, each loudspeaker (5) being round with the membrane diameter d and directed downwards, characterized in that the distance a between the centres of two adjacent loudspeakers (5) in the sound-ceiling (4) is less than or equal with 3.5 d.

4. A device according to claim 2, two round loudspeakers with different membrane diameters being placed beside each other, characterized in that the distance between the centres of these two loudspeakers is less than or equal with 3.5 of the diameter of the larger membrane.

5. A device according to claim 2, at least certain of the loudspeakers having another form than round, characterized in that the distance between the centres of two similar, adjacent loudspeakers is less than or equal to 5/4 of the perimeter of the membrane of one of said similar loudspeakers.

6. A device according to claim 2, two adjacent loudspeakers having another form than round and having different sizes regarding the membranes, characterized in that the distance between the centres of these two loudspeakers is less than or equal to 5/4 of the perimeter of the membrane of one of the larger loudspeaker.

7. A device according to any one of claims 2–6, characterized in that the sound-ceiling (4) comprises a plate (6) above which there is arranged a sound-isolating layer (7).

8. A device according to any one of claims 2–6, the space having a floor, characterized in that the sound-ceiling can be raised and lowered between different levels over the floor.

* * * * *